United States Patent [19]

Deeter et al.

[11] 3,972,375

[45] Aug. 3, 1976

[54] AUGER DRIVE WITH AUXILIARY POWERTRAIN BOXES

[75] Inventors: Ronald C. Deeter, Malvern; John Pozniko, Salem, both of Ohio

[73] Assignee: The Salem Tool Company, Salem, Ohio

[22] Filed: Feb. 18, 1975

[21] Appl. No.: 550,465

Related U.S. Application Data

[62] Division of Ser. No. 398,971, Sept. 20, 1973, Pat. No. 3,918,536.

[52] U.S. Cl. ..... 173/50; 299/55

[51] Int. Cl.[2] ..... E21C 25/58

[58] Field of Search ..... 299/55–57; 175/91, 108; 173/50–52, 29

[56] References Cited

UNITED STATES PATENTS 3,663,062 5/1972 Young et al. ..... 299/57

*Primary Examiner*—Ernest R. Purser

*Attorney, Agent, or Firm*—Bosworth, Sessions & McCoy

[57] ABSTRACT

Auger apparatus comprising a driving power train in which one or two auxiliary powertrain boxes are provided, two auxiliary boxes being used when two or more augers are to be driven, and one auxiliary box being used when only one auger is to be driven. The apparatus as a whole can be substantially shorter and closer to the ground than the apparatus of this type heretofore used, which required less excavating of the ledge adjacent the wall in which drilling is to occur, and makes possible easier transportation.

5 Claims, 5 Drawing Figures

3.
3.

AUGER DRIVE WITH AUXILIARY POWERTRAIN BOXES

This is a division of application Ser. No. 398,971, filed Sept. 20, 1973, now U.S. Pat. No. 3,918,536 granted Nov. 11, 1975.

FIELD OF THE INVENTION

The invention relates to auger apparatus of the type that bores one or more deep holes by an auger formed of a string of connected auger sections, and more particularly to such auger apparatus providing increased flexibility, speed and efficiency of operation, particularly in the handling of the auger sections.

The invention provides exceptional advantages when employed in auger mining machines, of the type adapted to be positioned adjacent an upwardly extending wall to recover coal from a seam that is exposed in such wall and extends generally laterally into the earth. Therefore, for convenience, the invention will be discussed in connection with such a machine.

Auger mining machines of this type comprise one or more augers each embodying a cutting head of relatively large diameter connected to and rotationally driven by a string of helically vaned auger sections driven from the machine. The cutting head penetrates the coal seam, and the mined coal is transported rearwardly from the cutting head along the vaned auger string to the entrance of the hole cut by the cutting head where the coal is collected and removed. As the cutting head is caused to penetrate into the hole, it is necessary to introduce auger sections into the string until the desired depth of the auger string is reached to achieve the desired depth of hole.

After the cutting head has penetrated the desired depth of hole, it is necessary to withdraw it by removing auger sections until the cutting head is out of the hole. The machine as a whole then may be moved laterally to another position where its auger or augers can drill another hole or holes generally parallel to the previously drilled hole.

The maximum diameter of the auger to be used is largely determined by the thickness of the coal seam, an auger of smaller diameter being used for a thinner seam, and an auger of larger diameter being used for a thicker seam. Occasionally a coal seam that is being mined varies in thickness; or in the same wall there are seams of widely varying thickness; or in the locality in which the mining machine is working there are different seams of widely varying thicknesses.

It is desirable that a single machine be capable of handling and driving a varying number of augers of widely varying diameter and length in order to permit maximum utilization of the machine and maximum recovery of coal with the single machine without the necessity of bringing in other machines. For a given power output of an auger machine, it is also most desirable that the machine be capable of driving a single auger of as large diameter as possible and that it also be capable of driving several augers of smaller diameter from the same power source within the power output capabilities.

SUMMARY OF THE INVENTION

It is an object of the invention to provide auger apparatus that overcomes the disadvantages indicated above of prior apparatus and satisfies the desired aspects set forth above.

It is another object of the invention to provide auger apparatus embodying as many as desired of the features summarized above, including apparatus providing all of such features. It is a further object of the invention to provide auger apparatus that is flexible in operation in permitting use of a wide range of sizes of augers and a wide variety of numbers of augers. A further object is the provision of auger apparatus that is dependable in operation, requires little maintenance and can be manufactured at reasonable cost.

The present invention provides auger apparatus, preferably a mining machine of the type discussed above, that overcomes such disadvantages and provides greatly increased flexibility in operation because it can be made adaptable to various mining conditions, including boring holes at substantial angles to the horizontal, without the necessity of replacing it with a different machine or necessity for manual handling or guiding of the auger sections.

According to the present invention, an auger mining machine may be provided that is adapted to drive one, two, three or even more augers of a wide range of diameters from a single power source.

BRIEF DESCRIPTION OF THE DRAWINGS

The above advantages, features and objects will become more clearly apparent from the following description of the preferred embodiments of the invention in connection with the accompanying drawings, in which.

DESCRIPTION OF THE PREFERRED EMBODIMENT

The auger machine of FIGS. 1 to 5 comprises a rigid main frame 1 from which two augers A and B are supported and driven. The augers are detachably connected at their outer ends to a cutting head assembly C and are made up of strings of connected identical auger sections S between the cutting head assembly and the auger machine. The cutting head assembly C shown is similar to that of FIG. 11 of U.S. Pat. No. 3,663,062 of May 16, 1972, and comprises a rigid frame rotatably supporting two cutting heads D that are driven by augers A and B made of strings of auger sections S. Other types of cutting head assemblies may be used such as those of FIG. 4 or other figures of that patent. The disclosure of U.S. Pat. No. 3,663,062 relating to cutting head assemblies and to other features referred to hereinafter is incorporated herein by reference.

Figure 4:
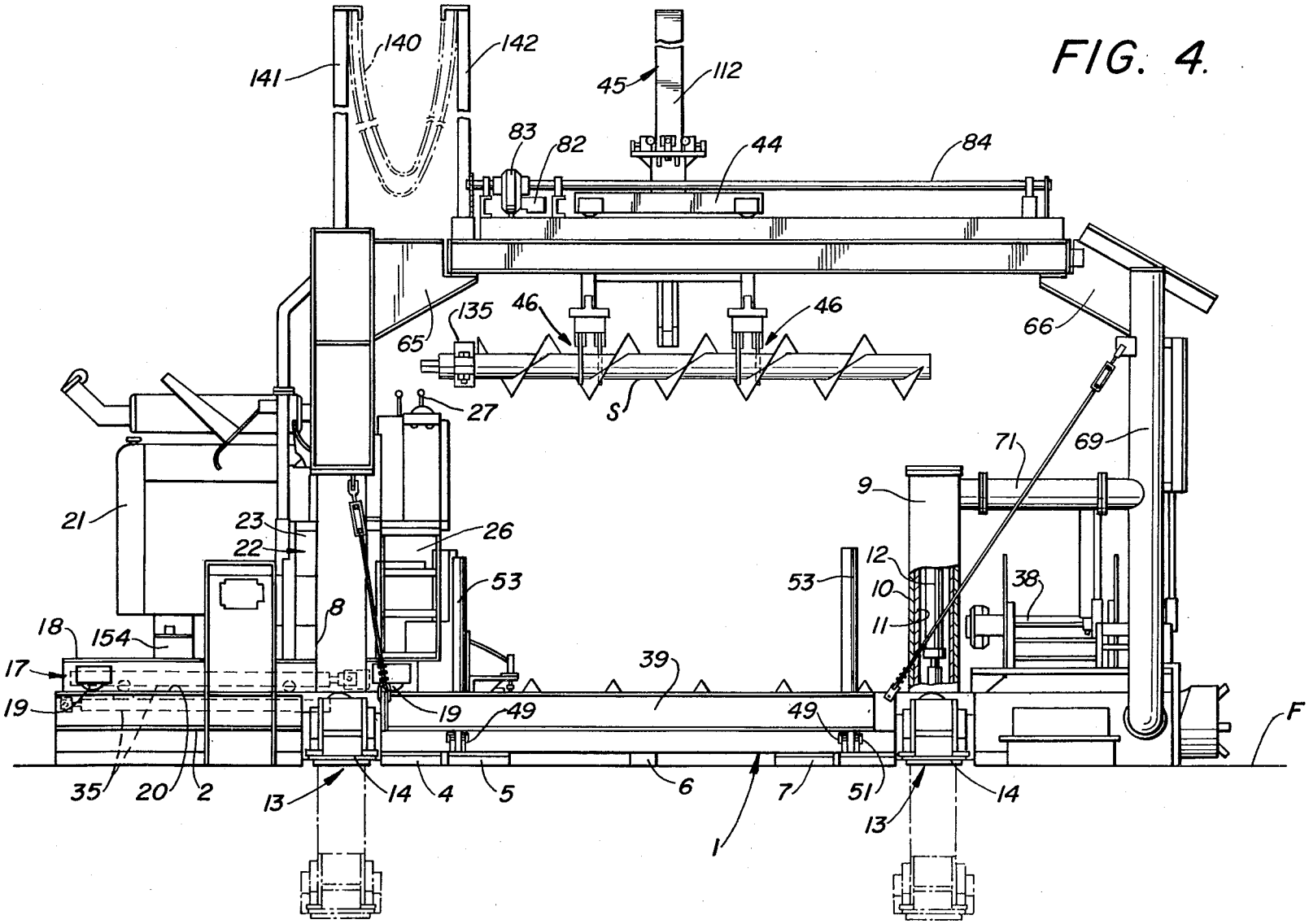
FIG. 4 is a side elevation of the machine to the scale of FIG. 2, showing in broken lines the jacks extended to raise the main portion of the apparatus.

Main frame 1 comprises a pair of spaced longitudinally extending massive parallel frame beams 2 and 3 rigidly joined by cross members 4–7 (FIG. 4). Near its ends, and in a corresponding position on either side, the main frame has four vertical jacks 8, 9 each comprising a vertical outer tubular member 10 rigidly fixed to the frame 1 and having a telescoping inner member 11 adapted to be moved downwardly and upwardly into bottom of member 10 by fluid cylinder 12 to raise or lower frame 1 as required. The lower ends of the telescoping members 11 of the two jacks 8, and the two jacks 9, at each end of the machine carry a skid assembly 13 comprising a skid 14 adapted to rest on the pit floor F and known hydraulic cylinder means 16 for causing relative movement between the members 11 and the skid longitudinally of the skid and hence laterally of frame 1, for predetermined distances within design limits. The jacks 8, 9 are capable of lifting the main frame and the portions of the machine carried by it free of the ground and the skid assemblies permit the frame and such portions to move in directions laterally of the frame as desired. By suitable manipulation of the jacks and skids in known manners, it is possible to move the machine laterally or closer or further from the wall into which the augers penetrate, as desired.

Figures 2, 3:
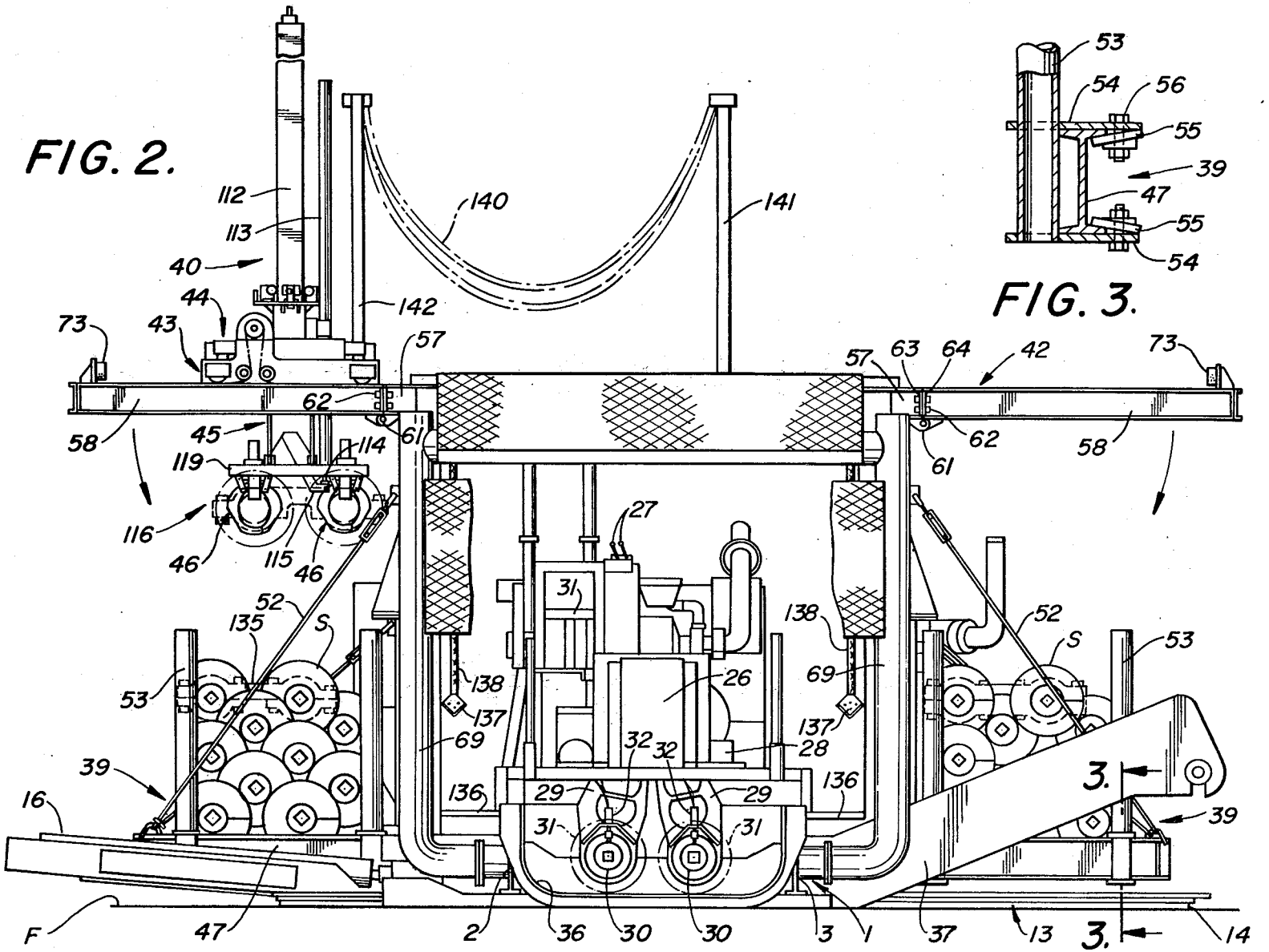
FIG. 2 is a front elevation of the machine of FIG. 1 and to a larger scale, the cutting heads being omitted and the auger sections in the machine being shown in broken lines.
FIG. 3 is a detail to a larger scale, along line 3—3 of FIG. 2, showing the adjustable mounting of a post on one of the auger section storage racks.

The skid assemblies are made of high strength steel and so designed that they are of minimum vertical thickness safely feasible for the load to be carried, so that when the skids are retracted as shown in FIGS. 2, 4 the distance between the floor F supporting the machine and the bottom edges of the augers and cutting heads is as small as feasible thus reducing the excavating necessary to provide the floor F and expose the coal seam, which is particularly advantageous where hard or rocky material must be excavated.

Frame 1 also supports a carriage 17 for guided movement longitudinally on beams 2 and 3, between an extreme rearward position shown in full lines in FIG. 4, to a forward position. This is to advance the augers A and B and cutting heads for cutting and to retract them for removal of the auger sections S, or to retract the carriage without the augers for insertion of additional auger sections to lengthen the augers A and B, in a known manner. Carriage 17 comprises a rigid frame 18 having wheels 19 (FIGS. 1, 4) that ride on guide portions 20 of beams 2 and 3.

An internal combustion engine 21 constituting the power source for rotating the augers is fixed on carriage frame 17 and drives through main power train means 22 comprising a clutch 23 having control lever 24, a flexible coupling 25, a shiftable transmission 26 having shift lever 27, and a main gear box 28, and two auxiliary power train means taking the form of gear boxes 29 that rotate two drive chucks 30. The main power train means is compact and of exceptionally short overall length to provide as short an overall length of the carriage 17 and auger machine as possible, the transmission 26 being as short as possible and positioned above main gear box 28. An operator on seat 31 on carriage 17 can manipulate the engine throttle controls, the clutch and shift levers and the controls for known means 32 for automatically locking and unlocking auger sections to the drive chucks 30. The apparatus also includes known unlatching means similar to that disclosed in U.S. Pat. No. 3,276,236, comprising a fluid cylinder 33 that can move means 34 to engage latches on the auger sections to disconnect auger sections from each other.

The carriage is moved between its rear and forward positions by fluid cylinder actuating means 35.

The frame 1 includes a belly plate 36 between and supported from beams 2 and 3 by cross members 5, 6. The belly plate supports those auger sections in the machine extending from drive chucks 30 to the front end of the machine at the wall into which the augers penetrate. Coal mined by the cutting heads and augers passes onto a conveyor 37 carried by the main frame near the front of the machine. The apparatus also includes auxiliary power means 38, such as an internal combustion engine and appurtenant apparatus for producing auxiliary power, such as pumped hydraulic fluid under pressure which through known means is controlled to actuate various other portions of the apparatus such as the jacks, the skids, the conveyor and hoist apparatus to be later described.

The machine of FIGS. 1 to 5 positively rotates the auger cutting heads D by rotation of the two augers A and B as will be described later. As the cutting heads are rotated and caused to penetrate the coal or other material being mined by movement of carriage 17, auger sections S from the storage racks 39 are inserted adjacent the drive chucks 30 when the carriage 17 is located in its rear position on frame 1, to extend the lengths of augers A and B as required as the holes are bored deeper by the cutters.

A hoist apparatus 40 for handling auger sections is supported from the main frame 1. This apparatus comprises two spaced parallel rails 41, 42 extending transversely of the auger machine over the auger storage racks 39 and over the central portion of the apparatus in which are located the auger sections forming the augers A and B. A bridge 43 is adapted to travel on the rails 41, 42. A trolley 44 is adapted to travel on the bridge 43 transversely of rails 41, 42. The trolley 44 carries a lift 45 that is movable upwardly and downwardly relative to the remainder of the trolley and that carries tongs 46 adapted to grasp simultaneously a pair of auger sections S and move them from either of the storage racks to the desired positions in the central portion of the machine where they can be connected to the driving heads 32 and to other auger sections, or to move them from such positions to the storage racks.

Each storage rack 39 (FIGS. 1–4) comprises two side beams 47 rigidly connected together at their outer ends by a cross beam 48, and pivotally connected at their inner ends by joints 49 having removable point pins 51. The outer ends of the racks are supported by cables 52 from the machine. The racks can therefore be removed or swung upwardly to reduce the width of the machine when it is moved to a different location. Each rack has upright posts 53 that are demountably and adjustably fixed to side beams 47 of the rack to hold auger sections of different diameters on the rack. As shown in FIG. 3, each post rigidly carries lateral members 54 that extend across a beam 47 and are clamped by members 55 and bolts 56.

In the illustrated apparatus, each of the hoist apparatus rails 41, 42 comprises a central portion 57 and two end portions 58. The end portions at each side of the machine are rigidly connected together by a cross member 59 to form a movable rail structure 60 that is connected by hinges 61 to the center portions 57 of the rails and is adapted to be firmly held in its lateral or extended position as shown in FIG. 2 by bolts 62 passing through flanges 63 and 64 on the central and side portions of the rails. By removal of the bolts, the movable rail structures 60 can be caused to hang downward to reduce the width of the machine when it is moved.

Rail 41 is supported by brackets 65 connected to the central portion 57 of the rail and mounted on the rear jacks 8 of the apparatus. The other rail 42 is supported from brackets 66 connected to the central portion of the rail and fixed to upwardly extending front posts 69 the lower ends of which are fixed to the main frame 1 of the apparatus. Intermediate side cross member 71 connects each post 59 to its associated front jack 9, to aid in stiffening and holding the post firmly in place. Posts 69 are located forward of the front jacks 9 for a purpose to be later described.

Rail 42 has a raised track 72 (FIGS. 1 and 2) to guide bridge 43 in a straight path along the rails. Both outer end portions 58 of each of rails 41, 42 carry stops 73 having rubber buffer portions to limit the travel of bridge 43 on rails 41, 42.

Bridge 43 comprises two beams 74, 75 extending between rails 41, 42 and rigidly held together by widely spaced intermediate cross members 76 and end cross members 77 and 78 fixed to the ends of beams 74, 75. At one end of the bridge cross member 77 carries a single roller 79 located midway between beams 74 and 75 and riding on rail 41; roller 79 engages track 72 to guide the bridge. At the other end of the bridge cross member 78 carries two rollers 80 adjacent the ends of the beams which rollers ride rail 42. The bridge is thus supported from three points on the beams 41 and 42, and thus is stable even though these in use may not be exactly level with respect to each other.

The bridge is moved either direction as required along rails 41, 42 by a fluid power motor 82 (FIG. 4) that drive through a gear box 83 a shaft 84 that extends along the bridge beams and sufficiently above them to clear trolley 44. Shaft 84 is rotatably carried by bearing brackets 85 fixed on members 77, 78. The shaft rigidly carries a drive sprocket 86 at each end outside of members 77, 78.

The apparatus of the invention is adapted to carry one, two, three or even more auger sections at various spacings to compensate for various numbers and diameters of auger sections, by proper positioning of a proper number of tongs which may be readily put in place, removed or adjustably spaced by means of the above described clamping means. The hoist apparatus could therefore be advantageously held to handle simultaneously the auger sections for the varying numbers of auger strings shown in U.S. Pat. No. 3,663,062.

The hoist apparatus of the machine of FIGS. 1–15 is controlled from either of two stations X on opposite sides of the machine, by use of pendant control means at such station by an operator, who can stand on either of the walkways 136 extending longitudinally along opposite sides of the machine. Such pendant control mean comprises a switch handset 137 (FIG. 15) at each station X, connected by suitable known electrical circuits through flexible cables 138, 139, 140, supported in part by masts 141, 142 on the frame of the machine and the trolley, that supply electrical power from a suitable source, such as batteries, on the machine, not shown, and that control operation of the fluid actuated motor 82 that moves bridge 43, fluid actuated cylinder 97 that moves the trolley 44, and the fluid actuated cylinder 113 that moves the lift member 45 in its upward and downward path.

It is desirable to provide locating indicia by which the bridge by visual observation can be rapidly and properly located transversely relatively to the frame of the apparatus so that the tongs on the lift member of the trolley can be properly aligned transversely relatively to the positions of the auger section or sections in the auger strings in the apparatus. Such indicia are illustrated as pointers 150 on the bridge and markers 151 on the rails 41, 42 of the apparatus, located so that they are aligned when the bridge is properly located over the auger section positions in the machine and so at least one set of cooperating indicia can be seen by an operator at either of stations X or the seat 31. For similar reasons, indicia such as pointers 152 on the trolley and markers 153 on the bridge may be provided to permit rapid, accurate location of the trolley longitudinally on the bridge by visual observation.

The illustrated apparatus also includes drive means by which either one or more auger strings may be driven, and in which augers of different sizes may be driven.

Figure 1:
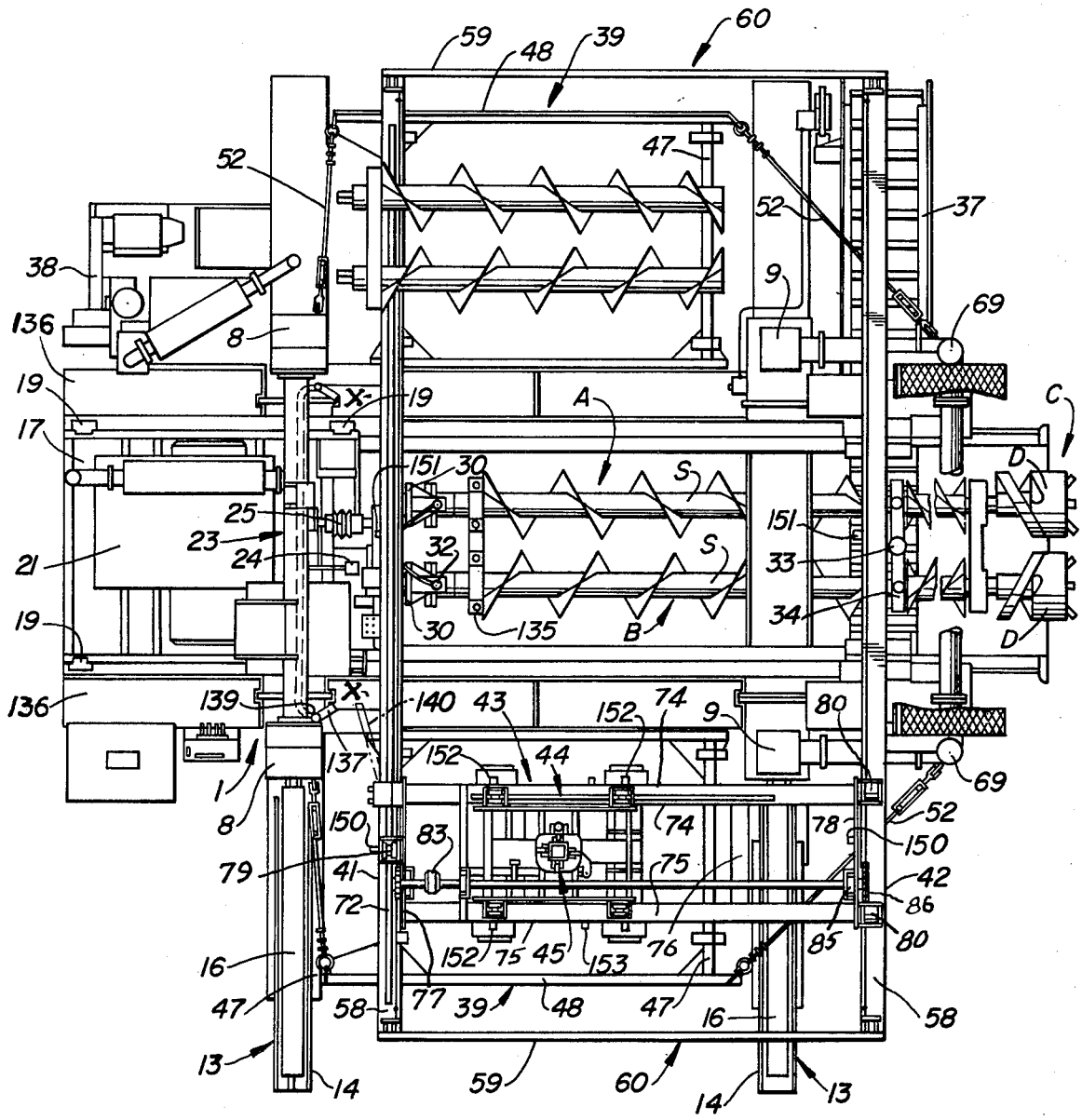
FIG. 1 is a plan of an auger mining machine embodying the invention, useful for mining coal in seams, having two auger strings with two cutting heads, connected to a single power source, and having hoist means embodying the invention.

As shown in FIGS. 1 and 2, apparatus shown in these figures is adapted to drive two auger strings from main gear box 28 through two auxiliary power train boxes 29 and two auger drive chucks 30. The auxiliary boxes 29 may be similar to those disclosed in U.S. Pat. No. 3,663,062 in that they include gears by which the chucks 30 are driven from the main gear box. In a manner like that disclosed in the patent, the auxiliary gear boxes 29 may be adjustably positioned toward or away from each other to permit the proper positioning of augers of different sizes, and the rigid unit comprising the main gear box 28 and power source 21 may be raised or lowered by means of adjustable shims 154 and bolts 155 (FIGS. 4, 5) to raise or lower the axes of the augers and the driving heads 30 relative to the bottom plate 36 to accommodate different diameters of augers.

If it is desired to drive more than two cutting heads, three or more cutting heads as disclosed in U.S. Pat. No. 3,663,062 may be driven through a cutting head assembly from two auger strings or the auxiliary power train boxes 29 may each be adapted to drive more than one drive chuck and auger string, as a total of four drive chucks and corresponding auger strings, the auger sections for which may be readily simultaneously handled by the hoist apparatus of the invention by suitable adjustment of the member and spacing of the tongs.

Figure 5:
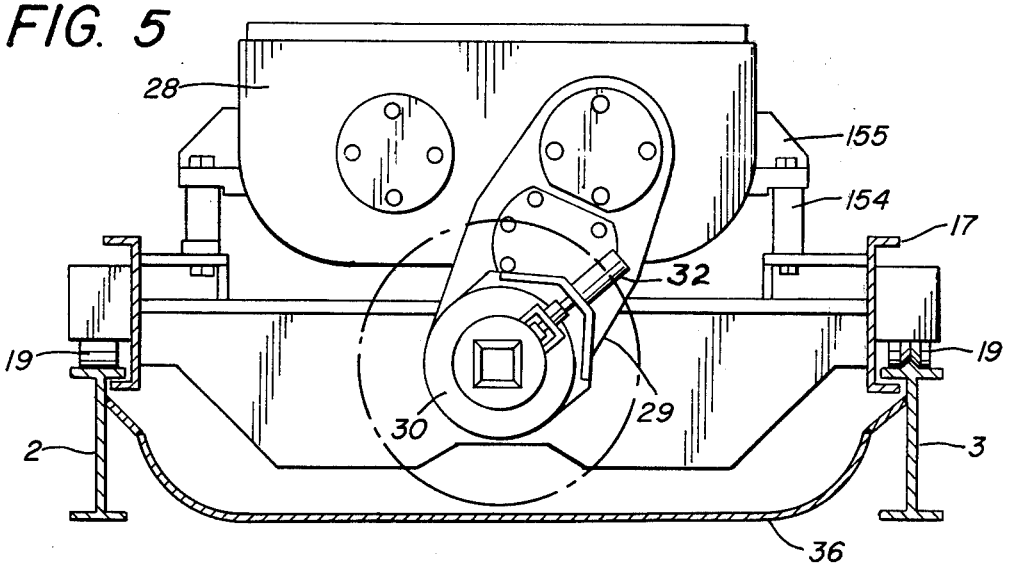
FIG. 5 is a front view of a portion of the auger drive means showing how the apparatus can be modified to drive a single auger by removal of one of the auxiliary gear boxes.

As shown in FIG. 5 in the present embodiment, one of the auxiliary boxes 29 may be removed and the remaining auxiliary box 29 may be swung into position so that its drive chuck 30 is centered relative to the width of the apparatus to permit the driving of a single auger. In such case the shims 154 should be the proper height to accommodate the diameter of the single auger, which is usually a large diameter auger.

Therefore, the auger drive means and the hoist apparatus of the machine are both flexible in that they can handle a varying number of augers of widely varying diameters, each cooperates with the other in making this possible.

Auger machines and particularly the hoist apparatus embodying the present invention may be advantageously used for boring holes at a substantial angle from the horizontal, as shown in FIG. 19, since the hoist apparatus makes possible proper and accurate placement, removal and handling of auger sections with safety to the operators, despite the substantial inclination of the auger sections as they are lifted.

Apparatus embodying the invention may be used for purposes other than mining coal.

Various modifications apparent to those skilled in the art, in addition to those indicated, may be made in the apparatus and methods indicated above, and changes may be made with respect to the features disclosed, provided that the elements or steps set forth in the claims hereof or the equivalents of such be employed.

What is claimed is:

1. Auger apparatus comprising a frame, power supply means carried by said frame, rotatable auger drive means associated with said frame, and power train means adapted to transmit power from said power supply means to said auger drive means, said power train means comprising main power train means and a plurality of auxiliary power train means each adapted to transmit power to an auger drive means and from it to an auger included in a plurality of augers, each auxiliary power train means being connected to said main power train means by means adapted to transmit power from said main power train means through said auxiliary power train means to an auger drive means through a range of adjustable positions of said auxiliary power train means relative to said main power train means, said auxiliary power train means being so designed that the number of auxiliary power train means can be reduced to a single auxiliary power train means by removal of all except said single auxiliary power train means and by adjustment of said remaining single auxiliary power train means to permit the driving of a single auger drive means and a single auger, each of said auxiliary power train means being adjustable to different height levels and different lateral positions of its auger drive means relative to said frame to permit variations in the spacing between the augers of said plurality of augers driven from said auxiliary power train means and to permit the use of augers of different diameters to be used, said height level adjustability being independent of said lateral position adjustability of each auxiliary power train means and the auger drive means through which it transmits power.

2. Apparatus as defined in claim 1 including means for adjusting the spacing between an adjacent pair of auxiliary power train means.

3. Apparatus as defined in claim 2 wherein said means for adjusting the spacing between said power train means includes a connection between each of said auxiliary power train means and said main power train means about a pivot axis, and wherein each auxiliary power train means may be adjusted to various positions about its respective pivot axis relative to said main power train means.

4. Apparatus as defined in claim 2 including means independent of said means for adjusting the spacing between said pair of auxiliary power train means, for adjusting said auxiliary power train means to different height levels relative to said frame.

5. The apparatus of claim 4 in which said height level adjusting means comprises shim means.

* * * * *

UNITED STATES PATENT AND TRADEMARK OFFICE

CERTIFICATE OF CORRECTION

PATENT NO. : 3,972,375

DATED : August 3, 1976

INVENTOR(S) : Ronald C. Deeter and John Pozniko

It is certified that error appears in the above-identified patent and that said Letters Patent are hereby corrected as shown below:

Column 5, Line 52, change "FIGS. 1-15" to --FIGS. 1-5--;
Line 58, change "FIG. 15" to --FIG. 2--.
Column 6, Line 66, after "horizontal," delete "as shown in FIG. 19,"

Signed and Sealed this

Twenty-first Day of June 1977

[SEAL]

*Attest:*

RUTH C. MASON
*Attesting Officer*

C. MARSHALL DANN
*Commissioner of Patents and Trademarks*